US005871151A

United States Patent [19]

Fiedrich

[11] Patent Number: 5,871,151

[45] Date of Patent: Feb. 16, 1999

[54] RADIANT HYDRONIC BED WARMER

[76] Inventor: Joachim Fiedrich, 20 Red Pine Dr., Carlisle, Mass. 01741

[21] Appl. No.: 766,402

[22] Filed: Dec. 12, 1996

Related U.S. Application Data

[60] Provisional application No. 60/008,533 Dec. 12, 1995.

[51] Int. Cl.[6] ..... F24D 5/10

[52] U.S. Cl. ..... 237/69; 237/71

[58] Field of Search ..... 219/5; 607/104; 165/168, 169, 171, 173; 237/69

[56] References Cited

U.S. PATENT DOCUMENTS

| | | | |
|---|---|---|---|
| 4,508,162 | 4/1985 | Radtke | 165/56 |
| 4,865,120 | 9/1989 | Shiroki | 165/56 |
| 5,119,988 | 6/1992 | Fiedrich | 237/8 |
| 5,259,379 | 11/1993 | Kim et al. | 607/104 |
| 5,500,007 | 3/1996 | Kim et al. | 607/104 |

*Primary Examiner*—Henry A. Bennett
*Assistant Examiner*—Derek S. Boles
*Attorney, Agent, or Firm*—Robert T. Dunn, Esq.

[57] ABSTRACT

A hydronic radiant heater bed warmer (RBW) is mounted in the support structure beneath the top surface of a conventional bed that has a mattress on springs supported by the bed support structure. The RBW includes: a source of heated supply water; a supply water line from the source; a return water line to the source; one or more heating loops each including [a length] lengths of tubing through which water flows from the supply line to the return line; a water pump in one of the water lines for pumping water over the closed path from the source, to the supply water line, to the heating loops, to the return water line and back to the source; thermally conductive plates mounted in the bed support structure under the top surface thereof; and accommodations for holding the lengths of tubing in intimate thermal contact with the plates including: spaced apart co-planar plate holding boards of the same uniform thickness, each having length and width and together providing a surface area for holding the plates and elongated spaces of uniform width therebetween for holding the lengths of tubing, the plates are held flat against the holding boards holding surface area, the elongated spaces have depth and length as well as uniform width of which the depth is equal to the boards thickness and the length is equal to the boards length and the lengths of tubing are held in the elongated spaces intimate thermal contact with the plates; so that the plates are heated by conduction of heat from the lengths of tubing; and the plates radiate heat to the user on the bed top surface.

19 Claims, 3 Drawing Sheets

RADIANT HYDRONIC BED WARMER

BACKGROUND OF THE INVENTION

This application claims priority to Provisional application No. 60/008,535 filed Dec. 12, 1995.

This invention relates to bed warming devices and systems that provide heat in a bed for the users comfort without interfering with the conventional comforts of the bed and more particularly to such systems that use water as the medium of heat exchange.

Electric Blankets and Water Beds

Electric blankets for a sleepers comfort have had considerable use, particularly for those who are not comfortable sleeping under several heavy blankets. The electric blanket is light weight and contains electric heating elements distributed throughout the blanket that are well insulated electrically and thermally so as not to shock or burn the user. Electric power to the elements is from a conventional AC power receptacle and is controlled by an electric switch/controller. There are some who say that the AC electric fields close to the users body are harmful and none deny that excessively worn elements can shock or burn the user.

Water beds have also had considerable use, primarily for the physical support they provide. For this purpose the water is in a flexible container and the users body is supported directly thereon. A large portion of the users body is in intimate thermal contact with the water and the water is a large thermal sink and so care must be taken to control the water temperature. A water bed must have means for heating the water contained so that it does not draw heat from or deliver heat to the users body. If the water is too cool, it can cause hyperthermia and if it is too warm it can cause hypothermia.

The electric blanket has only one purpose—to provide uniform heat flow to the users body—and does so when it is wrapped around the users body, but with some risk to the user. The water bed has only one purpose—to support the user comfortably—and does so when the user rests directly on the flexible water tight container, but with some risk of hyperthermia or hypothermia.

The present invention provides a bed warmer using techniques of hydronic radiant floor heating (RFH) and radiant wall heating (RWH) that are described in my U.S. Pat. No. 5,292,065, issued Mar. 08, 1994, entitled: RADIANT FLOOR AND WALL HYDRONIC HEATING SYSTEMS. That patent describes a dry installation technique of heating rooms in a dwelling for human comfort. It is believed by many that radiant heating is the ideal way to warm the human body.

In that patent a boiler supplies the system hot water to heating loops that include a heating element that is a length of tubing that conducts hot water from the boiler supply to the boiler return and is mounted in a wall or a floor of a room to be heated by RFH or RWH. The system includes a thermally conductive metal plate mounted in the floor or wall, adjacent a surface thereof and boards (sleepers) for holding the length of tubing in intimate thermal contact with the plate, so that the plate is heated by conduction of heat from the tubing and radiates heat to the room. The plate and holding boards are assembled to form a modular unit that has an accommodation the length thereof to hold the tubing in thermal contact with the plate. Several such modular units are arranges in line and side by side attached to the flooring for RFH, or the wall studs for RWH, and the length of tubing is inserted into in the tube holding accommodation. Thus, RFH or RWH is installed "dry" (without wet concrete, cement or plaster).

The present invention incorporates some of the techniques described in said U.S. Pat. No. 5,292,065 to provide a bed warmer having all of the conveniences of an electric blanket, but none of the limitations or dangers thereof and none of the problems encountered with water beds.

SUMMARY OF THE INVENTION

It is an object of the present invention to provide means for warming a bed for the comfort of the user having none of the limitations of electric blankets or water beds.

It is another object to provide a bed warmer that radiates heat from below the user from a warm source that the user is not in direct contact with.

It is another object to provide such a bed warmer wherein the heat transfer medium is continually flowing water that carries heat to the bed from a source separate from the bed.

It is another object to provide such a bed warmer wherein the heat transfer medium is continually flowing water that carries heat to the bed from a source separate from the bed and the source is an electric AC receptacle.

According to embodiments of the present invention a hydronic radiant heater bed warmer (RBW) is mounted in the support structure beneath the top surface of a conventional bed that has a mattress on springs supported by the bed support structure. The RBW includes: a source of heated supply water; a supply water line from the source; a return water line to the source; one or more heating loops each including a length of tubing through which water flows from the supply line to the return line; a water pump in one of the water lines for pumping water over the closed path from the source, to the supply water line, to the heating loops, to the return water line and back to the source; thermally conductive plates mounted in the bed support structure under the top surface thereof; accommodations for holding the lengths of tubing in intimate thermal contact with the plates so that the plates are heated by conduction of heat from the lengths of tubing; and the plates radiate heat to the user on the bed top surface.

DESCRIPTION OF EMBODIMENTS OF THE INVENTION

Figure 1:
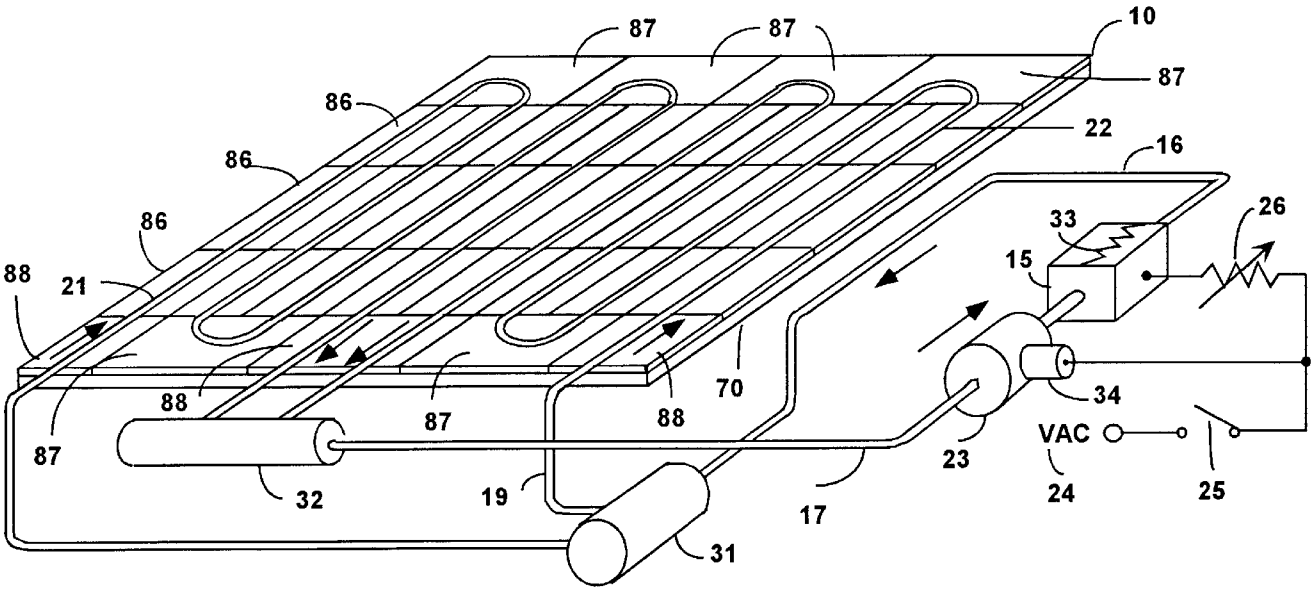
FIG. 1 is a perspective view of the bed warmer system including several modular units assembled side by side and end to end on a supporting board, all located under the mattress of a bed, the assembly including radiating metal plates and two loops of hydronic radiant heating tubing from a hydronic heating distribution system in which the water is heated electrically.

FIG. 1 is a perspective view of a hydronic radiant heater bed warmer (RBW) system 9 according to the present invention. As shown, the RBW heating platform 10 is mounted in the bed support structure 11 beneath the bed top surface 12 of a conventional bed 8 that has a mattress 13 on springs 14 supported by the bed frame 11. The RBW system includes: a source 15 of heated supply water; a supply water line 16 from the source; a return water line 17 to the source; two heating loops 18 and 19 each including a length of tubing 21 and 22 respectively, through which water flows from the supply line to the return line; a water pump 23 in one of the water lines for pumping water over the closed path from the source 15, to the supply water line 16, to the heating loops 18 and 19, to the return water line 17 and back to the source 15.

For feeding water to two or more heating loops like 18 and 19, a supply line header 31 is used to distribute supply water flow evenly from supply line 16 to each loop. Likewise, at the other ends of the loops a return line header 32 is used to feed return water from the loops evenly to the return line 17.

The source 15 is a heat exchanger that includes a path for water flow therethrough and an electric heating element 33. The electric element 33 is energized from the available source such as a receptacle 24 on the premises AC power line. The pump 23 includes an electric drive motor 34, also energized from the receptacle 24. An electric switch 25 turns on the electric heating element and the electric motor and electric power to the heating element is variable by controller 26 in the electric line to the heating element.

The RBW heating platform 10 includes thermally conductive metal plates 80, each with a groove 81 therein for holding the lengths of tubing 21 and 22 in intimate thermal contact with the plates so that the plates are heated by conduction of heat from the lengths of tubing and the plates radiate heat to the user on the bed top surface. More particularly, the RBW heating platform 10 is comprised of several modular units of different kinds, 86, 87 and 88, arranged side by side and end to end on the support board 70. This assembly of modular units holds tubing lengths 21 and 22 which are continuous lengths laid down serpentine shape from modular unit to modular unit, embedded in the grooves of the plates and held securely therein by the groove structure itself and by a filler material therein.

Where the tubing turns at the end of a straight run along an end modular unit 86, another type of modular unit 87 is used, in which the groove 104 for the tubing turns 180 degrees, as shown. Unit 87 is comprised of sleeper pieces 101 and 102, heat conductor radiating metal plate 103 having the groove 104 therein that projects into the space between sleepers and reinforcing web 105.

First Embodiment

Figure 2:
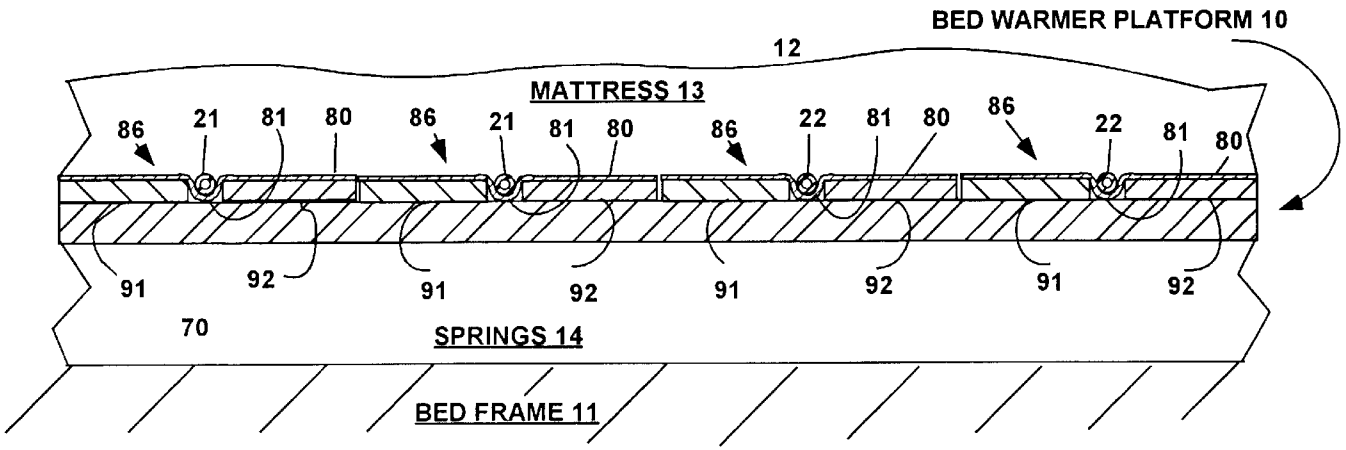
FIG. 2 is an enlarged cross section view of part of the assembly of FIG. 1 showing several of the modular units of a first embodiment that has a radiating metal plate with a groove therein the length thereof and plate holders, the modular units being arranged side by side under the bed mattress (on the bed springs) and the length of tubing (heating loop) inserted in the grooves.

FIG. 2 is an enlarged end view of part of the RBW heating platform 10 on the support board 70 showing several modular units of the first embodiment herein, each an assembly of two holder boards (sleepers) like 91 and 92, a thermally conductive metal radiating plate, like plate 80 having a groove 81 the length thereof, and inserted tubing lengths 21 and 22 in the grooves, the modular units being arranged side by side and end to end on the support board 70 and located, for example, between the bed springs 14 and mattress 13.

Second Embodiment

Figure 3:
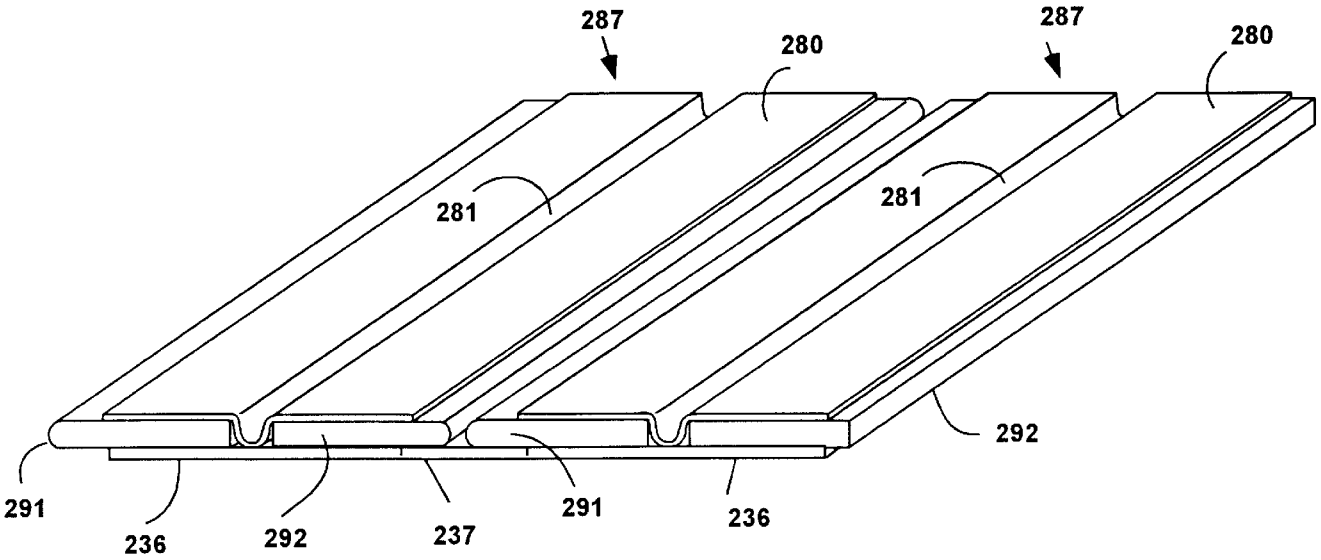
FIG. 3 is a perspective view of several modular units of a second embodiment for the hydronic bed warmer system shown in FIG. 1, wherein the modular units are joined by flexible webbing.

FIG. 3 is a perspective views of modular units of the second embodiment herein, that can be arranged as shown in FIG. 1 without the support board 70. Two long modular units 286 for holding a straight length of the tubing are shown in FIG. 3 connected together by webbing 237. They are similar to modular units 86 shown in FIGS. 1 and 2, but are connected side by side flexibly by webbing 237 and the sleeper boards of side by side modular units are spaced apart and may be rounded to permit the flexing. Here, straight modular unit 286 is comprised of sleeper boards 291 and 292, heat conductor/radiator plate 280 having a groove 281 that projects into the space between the unit support boards 291 and 292 and reinforcing web 238 that connects the support boards together.

Figure 4:
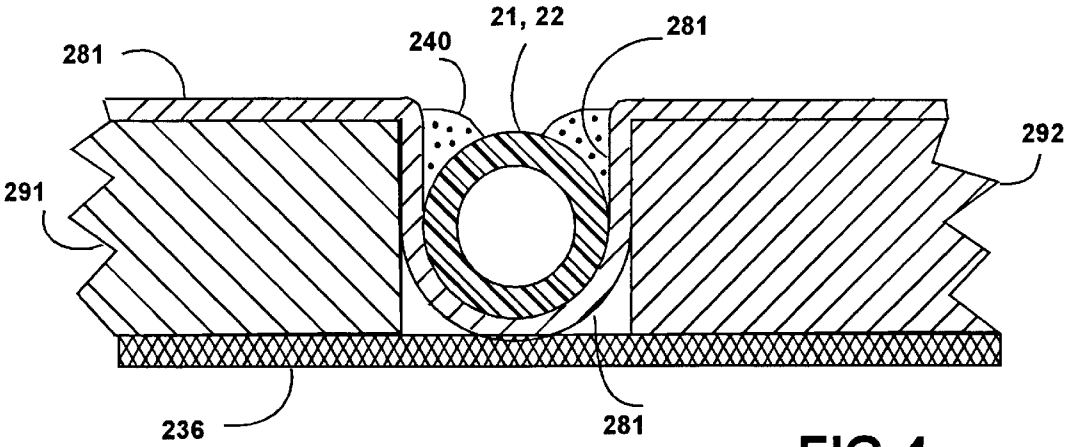
FIG. 4 is a very enlarged cross section view of part of a modular unit of the second embodiment showing the metal plate and groove therein, holder pieces, inserted tubing, compliant thermally conductive filler material adhering the tubing in the groove in the plate in intimate thermal contact therewith and flexible webbing joining the holder pieces and modular units.

FIG. 4 is a very enlarged cross section view of the center part of one of the straight modular units 287 showing the space 235 between support boards into which the plate groove 281 projects. The tubing length 21 or 22 is inserted into the groove and secured therein by compliant filler material 240. The webbing 237 reinforces the unit structure.

Third Embodiment

Figure 5:
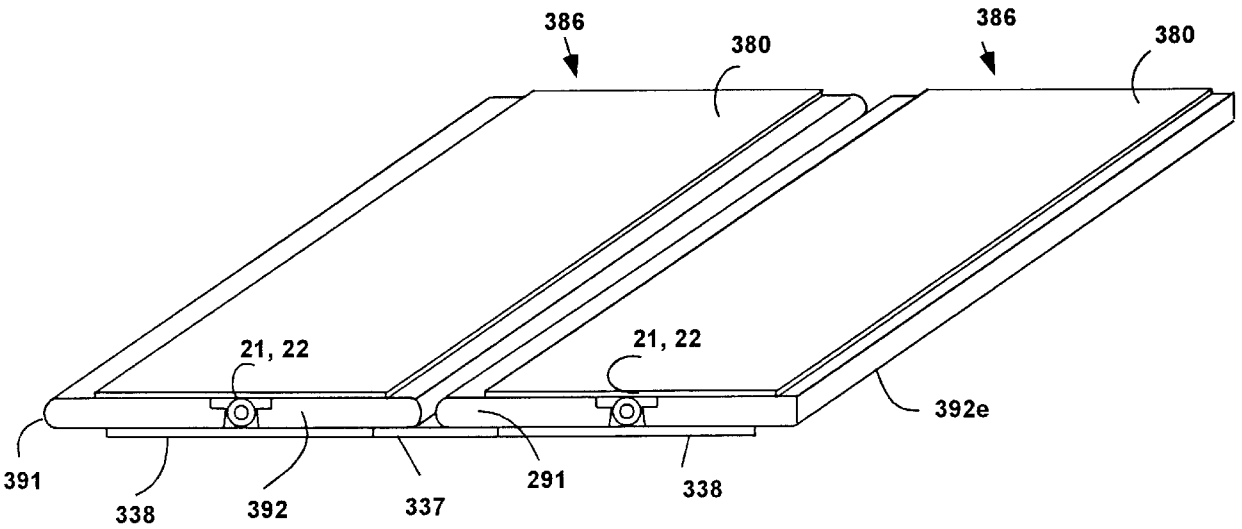
FIG. 5 is a perspective view of the several modular units of a third embodiment for the hydronic bed warmer system shown in FIG. 1, wherein the radiating metal plate is flat and a slot for holding the tubing thereagainst is defined by the flat plate and two spaced apart holding boards, the tubing is inserted in the slot and compliant thermally conductive filler material adheres the tubing against the plate in intimate thermal contact therewith over a broad area of the plate provided by undercuts in the holding boards adjacent the plate, increasing the thermally conductive contact area of the tubing with the plate and the modular units are joined by flexible webbing.

FIG. 5 is a perspective views of modular units of the third embodiment herein, that can also be arranged as shown in FIG. 1 without the support board 70. Two long modular units 386 for holding a straight length of the tubing are shown in FIG. 5 connected together by webbing 337. They are similar to modular units 86 shown in FIGS. 1 and 2, but are connected side by side flexibly by webbing 337 and the sleeper boards of side by side modular units are spaced apart and may be rounded to permit the flexing. Here, straight modular unit 386 is comprised of sleeper boards 391 and 392, flat heat conductor/radiator plate 380 bridges the space between the unit support boards 391 and 392 and reinforcing web 338 connects the support boards together.

Figure 6:
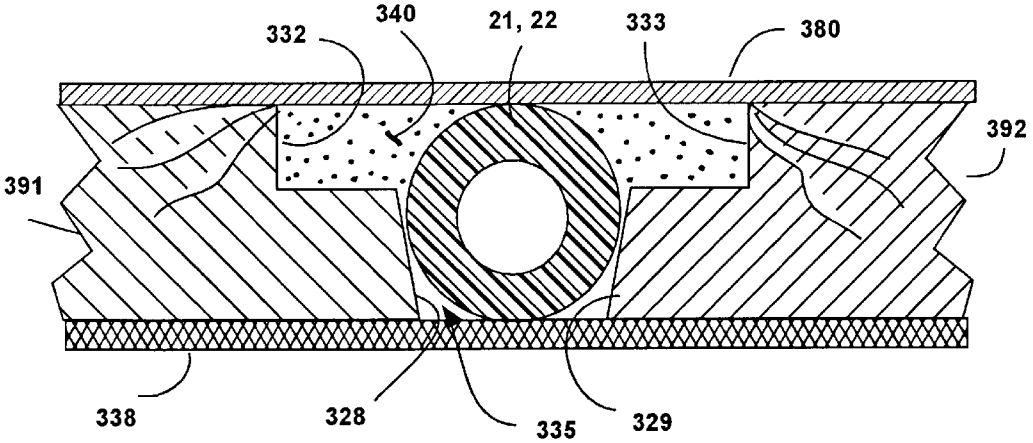
FIG. 6 is a very enlarged cross section view of part of a modular unit of the third embodiment herein showing the flat metal plate, tubing, holder pieces, undercuts, compliant filler material and flexible webbing joining the holder pieces.

FIG. 6 is a very enlarged cross section view of the center part of one of the straight modular units 386 showing the flat plate metal radiator 380 bridging the spaced apart support boards 391 and 392 and the space 335 between support boards into which the tubing 21 or 22 is inserted. Here the tubing must be inserted into this space from the bottom side of the space (the bottom side in FIG. 6) before the reinforcing webbing is attached. Furthermore, the ends of the support boards 391 and 392 that define space 335 are tapered at 328 and 329 and undercut at 332 and 333, respectively. Before the tubing is inserted in space 335, the undercut part is filled with a compliant thermally conductive material 340 that fills the undercut and around the tubing to provide a larger thermal contact area of the tubing with the metal radiating plate 380. Thus, the filler material 340 adheres the inserted tubing 21 against the plate 280 over a broad area thereof provided by the undercuts 332 and 333 and increasing the thermal contact therebetween.

CONCLUSIONS

While the invention hydronic radiant bed warmer described herein is described in connection with several preferred embodiments, it will be understood that it is not intended to limit the invention to those embodiments. It is intended to cover all alternatives, modifications, equivalents and variations of those embodiments and their features as may be made by those skilled in the art within the spirit and scope of the invention as defined by the appended claims.

I claim:

1. A bed warmer for a bed having a top surface on which the user rests and a support structure beneath said top surface spmprising, (a) a source of heated supply water and a supply water line from said source, (b) a return water line to said source, (c) one or more heating loops each including lengths of tubing through which water flows from said supply line to said return line, (d) a water pump in one of said water lines for pumping water over the closed path from said source, said supply water line, said heating loops, said return water line and back to said source, (e) thermally conductive plates mounted in said bed support structure under said top surface thereof, (f) accommodations for holding said lengths of tubing in intimate thermal contact with said plates including:

(g) spaced apart co-planer plate holding boards of the same uniform thickness, each having length and width and together providing a surface area for holding said plates and elongated spaces of uniform width therebetween for holding said lengths of tubing, (h) said plates are held flat against said holding boards holding syrface area, (i) said elongated spaces have depth and length as well as uniform width of which said depth is equal to said boards thickness and said length is equal to said boards length and (j) said lenths of tubing are held in said elongated spaces intimate thermal contact with said plates, (k) whereby said plates are heated by conduction of heat from said lengths of tubing and (l) said plates radiate heat to the user on said bed top surface.

2. A bed warmer as in claim 1 wherein:

(a) water flow through said closed path is continuous.

3. A bed warmer as in claim 1 wherein:

(a) a supply water header is provided fed by said supply water line and (b) said supply header feeds heated water to said heating loops.

4. A bed warmer as in claim 1 wherein:

(a) a return water header is provided fed by said heating loops and (b) said return header feeds water back to said source.

5. A bed warmer as in claim 3 wherein:

(a) a return water header is provided fed by said heating loops and (b) said return header feeds water back to said source.

6. A bed warmer as in claim 1 wherein said source of heated water includes:

(a) means defining a water flow path from said return water line to said supply water line, (b) an electric heater for heating water flowing through said defined water flow path and (c) a source of electric power for said electric heater.

7. A bed warmer as in claim 6 wherein:

(a) said source of electric power for said electric heater is an AC power receptacle of a domestic AC power system.

8. A bed warmer as in claim 7 wherein:

(a) an electric control is provided in circuit with said electric heater and said AC power receptacle.

9. A bed warmer as in claim 1 wherein:

(a) an electric motor is provided for said water pump and (b) a source of electric power is provided for said electric motor.

10. A bed warmer as in claim 6 wherein:

(a) an electric motor is provided for said water pump, (b) a source of electric power is provided for said electric motor and (c) an electric motor control is provided in circuit with said electric motor and said source of electric power.

11. A bed warmer as in claim 10 wherein:

(a) an electric control is provided in circuit with said electric heater and said source of electric power and (a) said source of electric power for said electric heater and for said electric motor is an AC power receptacle of a domestic AC power system.

12. A bed warmer as in claim 11 wherein:

(a) controls are provided for said electric heater and said electric motor, (b) said electric heater and said electric motor controls are such that said motor is energized whenever said heater is energized.

13. A bed warmer as in claim 1 wherein:

(a) said plate has length, width and thickness and said length and width define said radiating surface of said plate, (b) said plate is mounted in said bed structure oriented with said radiating surface thereof parallel to said bed surface.

14. A hydronic heating system as in claim 13 wherein:

(a) said accommodation for holding said length of tubing in intimate thermal contact with said plate, holds said tubing on the same side of said plate as said bed surface.

15. A hydronic heating system as in claim 13 wherein:

(a) said accommodation for holding said length of tubing in intimate thermal contact with said plate includes a plate support that provides an elongated space on the opposite side of said plate from said bed surface, and in which said length of tubing fits.

16. A hydronic heating system as in claim 13 wherein:

(a) said plate support includes two spaced apart elongated plate support pieces, (b) said elongated space is the space between said two spaced apart elongated plate support pieces, (c) said elongated space has a side that is closed by said plate and a side opposite thereto that is open and (d) said length of tubing is inserted into said elongated space through said open side thereof.

17. A hydronic heating system as in claim 16 wherein:

(a) said two spaced apart elongated plate support pieces each have length, width and thickness and (b) said elongated plate support piece length is substantially the same as said plate length.

18. A hydronic heating system as in claim 15 wherein:

(a) said two spaced apart elongated plate support pieces each have length, width and thickness and (b) said elongated plate support piece thickness is substantially equal to the outer diameter of said tubing.

19. A hydronic heating system as in claim 15 wherein:

(a) said elongated space two opposite sides are tapered so that said space widens towards said plate.

* * * * *